United States Patent [19]

Nishioka

[11] 4,100,384

[45] Jul. 11, 1978

[54] PUSHBUTTON SWITCH UNIT WITH REVERSIBLE SPRING

[75] Inventor: Matsuo Nishioka, Hirakata, Japan

[73] Assignee: Matsushita Electric Industrial Co., Ltd., Kadoma, Japan

[21] Appl. No.: 715,645

[22] Filed: Aug. 18, 1976

[30] Foreign Application Priority Data

Sep. 10, 1975 [JP] Japan ..... 50-110226
Sep. 10, 1975 [JP] Japan ..... 50-110227

[51] Int. Cl.[2] ..... H01H 13/56
[52] U.S. Cl. ..... 200/160; 200/5 E
[58] Field of Search ..... 200/16 B, 16 C, 16 D, 200/16 F, 153 J, 159 R, 159 A, 160, 291, 76

[56] References Cited

U.S. PATENT DOCUMENTS

| | | | |
|---|---|---|---|
| 3,286,050 | 11/1966 | Campbell et al. | 200/76 X |
| 3,656,181 | 4/1972 | Pack | 200/153 J X |
| 3,982,090 | 9/1976 | Lewis | 200/291 |
| 4,001,526 | 1/1977 | Olson | 200/16 D |
| 4,010,382 | 3/1977 | Nishioka et al. | 200/160 X |

*Primary Examiner*—James R. Scott

[57] ABSTRACT

A push-lock switch unit and assembly therefor. The push-lock switch unit utilizes an expanding spring extended between a housing of the switch unit and a movable member which reciprocally moves in the housing. The spring is biased diagonally in relation to the axial direction of the reciprocal movement so that the pushing force applied to the movable member to be pushed into the housing decreases as the movable member moves into the housing, thus enabling the operator to depress the switch with minimum force.

7 Claims, 17 Drawing Figures

PUSHBUTTON SWITCH UNIT WITH REVERSIBLE SPRING

BACKGROUND OF THE INVENTION

The present invention relates to a switch and, more particularly, to a push lock switch assembly of push lock switches for use in electrical and electronic equipment for example, for channel selection in television sets, audio appliances, telephones, etc.

Although, there have been proposed, conventionally, various types of push lock switches, the development is mostly focused on their functions, and in such switches the movement of the movable body is strongly resisted by spring means. Therefore, the switches require a comparatively large pushing or manipulating force for depressing the switches to the locked position, so that the operation thereof tends to be somewhat awkward, thus giving a heavy sense of touch to an operator.

Such a push lock switch is well known in the art, and generally includes an elongated housing, and an elongated movable body coaxially housed in said elongated housing. The movable body shifts in the housing between depressed and projected positions, and is normally biased towards the projected position by a spring means. The operation of the switch is such that the depression of the movable body closes the terminals disposed in the housing while projection of the movable body opens the terminals. Therefore, the switch is turned on when the movable body is moved to the depressed position by the application of an external pushing force to the body.

Since the spring means, in such conventional push lock switches, is biasing the movable body in a direction corresponding with the axial direction of the movable body, the external pushing force inevitably increases in relation to the degree of depression of the body in order to operate such switches, thus resulting in a hard touch when switching over such push lock switches. Such being the case, while there is a strong demand in the market for push lock switches which can be comfortably switched over in an easy manner upon mere depression without any disagreeable resistance, there have been none that will fully satisfy such a demand. Moreover, in any attempts to meet such a requirement with conventional constructions of known push lock switches, it is extremely difficult to attain the favorable light touch, and accordingly, development of push lock switches based on an entirely novel conception is necessitated through fundamental improvements of the structures of the known push lock switches.

Another disadvantage inherent in the conventional push lock switches which seek to provide easy operability is that they are liable to be affected by light vibrations or shocks, thus being readily released from their locked state. In order to overcome such drawbacks, some types of the conventional lock switches employ countermeasures to secure them in the locked state through an increase of the force of the spring for urging the movable body, which countermeasures, however, are inconsistent with the smooth operability and agreeable light touch manner during switching over.

Furthermore, in the conventional push lock switches it is difficult to detect whether or not the operating member is fully depressed. In other words, the operating member may be thought to be depressed fully even though it is only depressed halfway, thus presenting possibility of erroneous operation of the switch.

SUMMARY OF THE INVENTION

It is, therefore, a primary object of the present invention to provide a push lock switch unit which can be switched over in an easy manner with a light touch and minimum depressing force.

It is another object of the present invention to provide the push lock switch unit of the above described type with a lock means for locking the movable body in the depressed position positively in spite of any vibration and impulses applied to the push lock switches.

It is still another object of the present invention to provide the push lock switch unit of the above described type which can be assembled from one direction in the assembly line for simplifying the assembly steps.

It is a further object of the present invention to provide a push lock switch unit of the above described type which has a compact size and yet stable in its operation.

It is a still further object of the present invention to provide a push lock switch unit of the above described type which is has a simple construction and can readily be manufactured.

It is a still further object of the present invention to assemble a plurality of the push lock switch units of the above described type a multi-push lock switch system in which the depression of one switch unit operates another switch unit or units which are in the depressed position to return them to the projected position.

According to a preferred embodiment of the present invention, the push lock switch unit comprises an elongated, housing having an opening at its one end and including at least one pair of spaced terminals each having one end situated within the housing for external electric connection and an elongated movable body coaxially housed in the elongated housing for axial movement between depressed and projected positions. The movable body has one end extended outwards from the housing through the opening and the other end housed within the housing. The push lock switch unit further comprises spring means connected between the elongated housing and the elongated movable body and at least one contact member which is carried by the elongated movable body for electrically connecting the ends of the terminals within the housing to each other when the elongated movable body is moved to the depressed position by the application of an external pushing force.

Since the above described spring means exerts the expanding force on the elongated movable body in a diagonal direction with respect to the direction of movement of the elongated movable body for uring the elongated movable body towards the projected position, the expanding force gradually decreases as the elongated movable body is moved from the projected position towards the depressed position.

Provided in the above described push lock switch unit is an engaging means for engaging the movable body when it is in the depressed position so that the contact member is positioned between the pair of spaced terminals for electrically connecting the terminals.

Furthermore, according to the present invention, a plurality of push lock switch units can be assembled in one set in a frame means in which the depression of one push lock switch unit will cause the other push lock switch unit or units which are in the depressed position to return to the projected position.

According to the present invention, the push lock switch unit can be manipulated with a light pushing force, because the depressing force applied to the elongated movable body decreases in relation to the amount of the depression. Also, the disadvantage of causing an erroneous functioning can be eliminated because the full depression, i.e., positioning of the elongated movable body in the fully depressed position, can be obtained without heavy manipulation of the switch unit.

It should be noted that means are provided in the push lock switch unit for engagement with the movable body when it is in the depressed position, so that the push lock switch unit of the present invention will not be easily released from the depressed position by vibration and impulses applied to the push lock switch units.

BRIEF DESCRIPTION OF THE DRAWINGS

These and other objects and features of the present invention will become apparent from the following description taken in conjunction with a preferred embodiment thereof with reference to the accompanying drawings, wherein.

Before the description of the present invention proceeds, it is to be noted that like elements are designated by like reference numerals throughout the views of the attached drawings.

DETAILED DESCRIPTION OF THE PREFERRED EMBODIMENT

Figure 1:
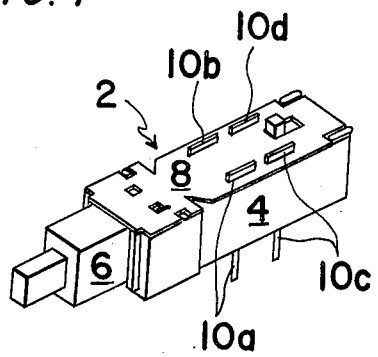
FIG. 1 is a perspective view of a switch unit of the present invention.

Referring now to the details of the drawings and first to FIG. 1, there is shown a push lock switch unit 2, generally called a switch unit in accordance with a preferred embodiment of the present invention. The switch unit 2 comprises an elongated housing 4 having a U-shaped cross section and an opening at one end thereof, an elongated movable body 6 coaxially housed in the elongated housing with one end portion thereof projecting out of the housing 4 through the opening for allowing reciprocal movement of the movable body 6 in the housing 4 and a lid plate 8 applied to the housing 4 for enclosing the movable body 6 in the housing 4. The above described elements, i.e., the housing 4, movable body 6 and lid plate 8 are made of electrically non-conductive or insulating materials such as synthetic resin. The switch unit 2 further includes two pairs of terminals 10*a*, 10*b*, 10*c* and 10*d*, each separately situated within the housing 4, with leg portions thereof projecting outwardly from the housing for external electrical connections. The function of the switch unit 2 is such that the terminals of each pair of the terminals, for example terminals 10*a* and 10*b*, are electrically connected when the movable body 6 is pushed into the housing to a depressed inserted position, while the terminals 10*a* and 10*b* are disconnected when the movable body 6 is returned to a projected position.

For the sake of better understanding of the present invention, the side from which the movable body 6 is projecting from the housing 4 is called the front side, and the side in which the movable body is housed in the housing 4 is called the rear side.

Figure 2:
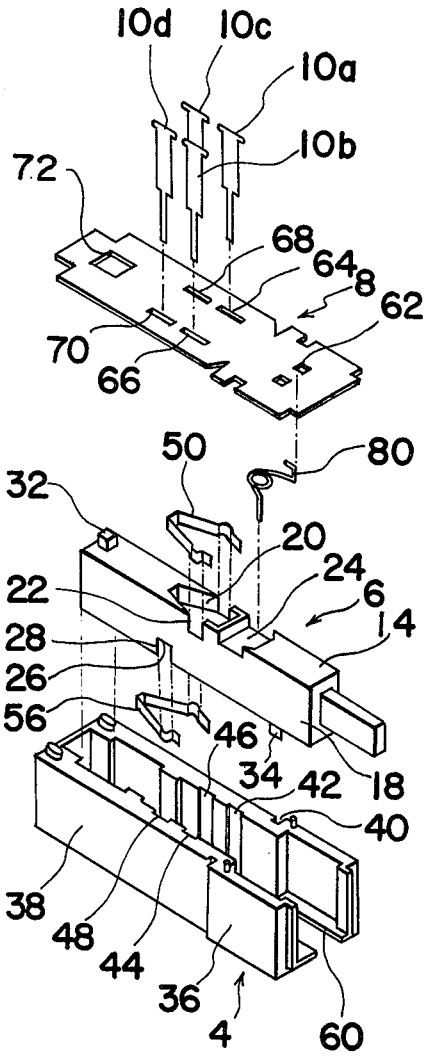
FIG. 2 is an exploded view of the switch unit shown in FIG. 1.

Referring to FIG. 2, the switch unit 2 of FIG. 1 is exploded to show the internal elements of switch unit 2, and also the manner in which the movable body 6 and the terminals 10*a* to 10*d* are assembled.

The elongated movable body 6 has four peripheral faces which are upper face 14, lower face 16 (not shown) and two side faces 18. Formed on the upper face 14 at almost the central portion thereof is a first recess 20 which extends along the axial direction of the movable body 6 and broadens towards the front end of the movable body 6 and then is again narrowed so that the first recess 20 has cutout portions 22 formed in the opposing side faces 18. Also formed on the upper face adjacent to first recess 20 to the front side thereof is a second recess 24 which extends laterally across the upper face 14. A third recess 30 which can be seen in FIG. 4 having the same shape as that of the first recess 20 is formed on the lower face 16 at a position a little to the rear of the first recess 20 towards the rear end so that the cutout portions 22 of the first recess 20 and the cutout portions 28 of the third recess 30 are not positioned at the same distance from the rear end of the elongated movable body 6, but are diagonally separated. In other words, the cutout portions 22 and 28 do not overlap each other when viewed from the top.

Figure 5:
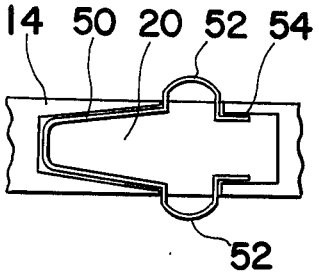
FIG. 5 is a fragmentary view showing details of the contact member positioned in the movable body.

The first recess 20, as most clearly seen in FIG. 5, receives therein a contact member 50 having a shape somewhat like a tongs with each arm having an outwards distended portion 52 at the end portion thereof. The tong-like shape of the contact member 50 improves the contact between the distended portions thereof and the face of a terminal at a comparatively low contact pressure. In other words, the contact member 50 will slide smoothly along the inner wall of the housing 4, without producing heavy frictional force therebetween.

It should be noted that the contact member 50 can have two or more branches from the intermediate portion of the arm portion thereof to the end portion, so that the number of the contact points can be increased, thus providing higher reliability of contact.

When the contact member is in the recess 20, the distended portions 52 project outwardly from the movable body 6 through the cutout portions 22, while the tip 54 of the arm engages the wall of the recess 20. In the similar manner, another contact member 56 of a same shape is placed into the third recess 30. Further formed on the elongated movable body 6 are two projections. The first projection 32 is provided on the upper face 14 at the rear end portion thereof and has the shape of a cubic block, while the second projection 34 is provided on the lower face 16 at front end portion thereof.

Figure 4:
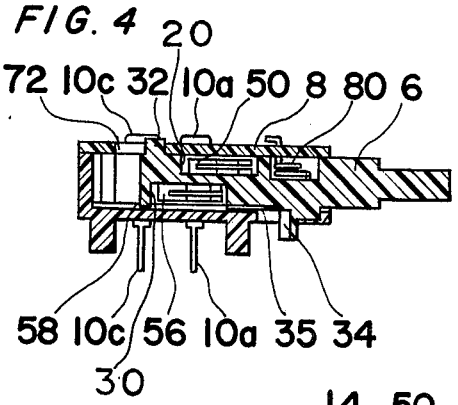
FIG. 4 is a cross sectional view of the switch unit taken along the line III—III of FIG. 3 with a top lid applied thereto.

Still further provided on the elongated movable body 6 is a blade portion 35, as most clearly seen in FIG. 4, which extends parallel to the axial direction of the body 6.

The elongated housing 4 is composed of two sections i.e., head portion 36 and tail portion 38, which are separated by a neck portion 40. In order for the elongated housing 4 to support the terminals 10*a* to 10*d*, there is provided four grooves 42, 44, 46 and 48 in the inner face of the housing 4 in a direction perpendicular to the axial direction thereof. The grooves 42 and 46 are formed on one side of the inner face of the elongated housing 4 and the grooves 44 and 48 are formed on the other side of the inner face of the elongated housing in positions directly opposite the grooves 42 and 46, respectively. An opening (not shown) is formed at the bottom of each groove so that the leg portion of a terminal can extend through the housing 4 to project therefrom when the terminal is placed into the groove. Further formed in the housing 4 is an elongated cutout portion 60 at the bottom of the head portion 36 extending to the axial direction of the housing 4. For placing the elongated movable body 6 into the elongated housing 4, the second projection 34 on the movable body 6 is introduced into the cutout portion 60, and projects outward from the housing 4.

Figure 3:
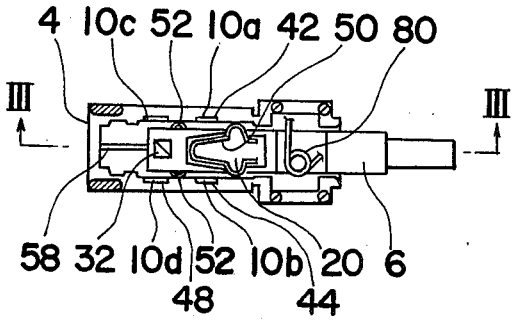
FIG. 3 is a top plan view of the switch unit shown in FIG. 1, with a top lid thereof removed.

Still further formed in the housing 4 is an elongated groove 58 at the bottom of the tail portion 38, as most clearly seen in FIG. 3, for receiving the blade portion 35 of the movable body 6 therein, thereby guiding the movable body 6 along the groove 58 is smooth reciprocal movement.

The lid plate 8 has a shape to the peripheral configuration of the housing 4 and has a plurality of openings. The first opening 62 in the front portion thereof is for receiving the end of one arm of a spring 80 which is to be placed in the second recess 24 on the upper face of the movable body 6. The end of the other arm of the spring 80 is inserted into a pin hole (not shown) formed in the second recess 24, to be supported therein. Elongated openings 64, 66, 68 and 70 are formed at approximately the central portion of the lid plate 8 for inserting the terminals. The location of the openings 64, 66, 68 and 70 is such that the openings 64 and 68 are in alignment with each other and the openings 66 and 70 are in alignment with each other in parallel relation to the axial direction. The openings 64 and 66 are positioned at the same distance from the rear end and the openings 68 and 70 are positioned at the same distance from the rear end but at a distance less than the former distance. The last opening 72 which is a rectangular opening is formed at the rear end portion of the lid plate 8 for receiving the cubic projection 32 on the elongated movable body therein when the lid plate 8 is placed on the housing 4, after the movable body 6 has been placed into the housing 4.

The terminals 10*a*, 10*b*, 10*c* and 10*d* are inserted into the openings 64, 66, 68 and 70, and fixedly positioned by the grooves 42, 44, 46 and 48, while the leg portions thereof extend through the bottom and project outwardly from the housing 4.

It should be noted that the faces of the positioned terminals are on the same plane with the inner face of the housing 4 so that the movement of the movable body 6 in the housing 4 is smooth.

In order to position the lid plate 8 on the housing 4 in a predetermined position, a plurality of pin projections can be provided on the housing 4 which correspond with cutout portions or recesses formed in the lid plate 8. For fixedly holding the lid plate 8 on the housing 4, the rim of the lid plate 8 can be bonded to the housing 4, or otherwise, the terminals can be given a T-shape to maintain the lid plate 8 in position by the engagement between the terminals and the lid plate 8, provided that the projecting leg portion of each terminal is twisted or bent aside.

Referring to FIG. 3, the movable body 6 is in the projected position. The distended portions of the upper contact member 50 are positioned in front of the terminals 10*a* and 10*b*, while the distended portions 52 of the lower contact member 56 are positioned between the terminals 10*a* and 10*c*, and the terminals 10*b* and 10*d*, so that the terminal 10*a* is not connected to the terminal 10*b*, and the terminal 10*c* is not connected to the terminal 10*d*. Upon exertion of the external force on the movable body 6 to push it into the depressed position, the upper contact member 50 electrically connects the terminal 10*a* with the terminal 10*b* and the lower contact member 56 connects the terminal 10*c* with the terminal 10*d*.

It should be noted that the depressed and projected positions of the movable body 6 are determined by the length of the rectangular opening 72, in which the cubic projection 32 of the elongated movable body 6 moves back and forth. Needless to say, the projection 32 and the opening 72 can be formed in any other place in the assembly which is available.

In order to keep the switch unit 2 in the depressed position or ON condition, the projection 34 provided on the movable body 6 engages a lock means which will be described later in detail. On the other hand, to bring the switch unit 2 to its projected position or OFF condition, the engagement between the projection 34 and the lock means is released by a releasing means described later, and the movable body 6 is forced to project outwardly by the force of the spring 80.

Figure 6:
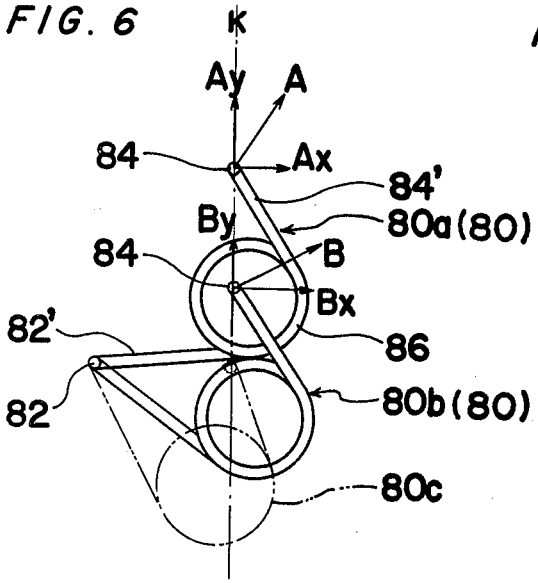
FIG. 6 is a schematic diagram for explaining the operation of the spring means employed in the switch unit of FIG. 1.

Referring now to FIG. 6, showing a schematic diagram of the spring 80, in which one end 82 of an arm 82′ is supported by the lid plate 8 and the other end 84 of an arm 84′ is supported by the elongated movable body 6, while the portion between the arms 82′ and 84′ i.e., spring portion 86 is accommodated in the recess 24 formed in the elongated movable body 6. The spring portion 86 is formed in a spiral form, but it is possible to have the spring portion 86 in the form of a hair pin spring. The line K corresponds with the axial direction of the movable body 6. The position of the spring 80 designated by the reference numeral 80*a* corresponds with the projected position of the movable body 6, while the position of the same designated by the reference numeral 80*b* corresponds with the depressed position of the movable body 6. When the spring 80 is positioned as at 80*a*, the expanding force of the spring 80 is indicated by the vector A which can be divided into an axial direction a vector component A*y*, and vector component A*x* perpendicular to the vector component A*y*. In a similar manner, the expanding force of the spring 80 in position 80*b* is indicated by the vector B in which B*y* is the axial direction vector component and B*x* the vector component perpendicular to the vector component B*y*. Since the spring 80 is a type of expanding spring, the expanding force of the spring 80 increases with the decrease of the distance between the two ends 82 and 84 thereof, and thus the vector B is greater than the vector A. However, because the supporting points 82 and 84 of the spring 80 are not in alignment with the axial direction of the movable body 6, the vector component parallel to the axial direction decreases with a decrease of the distance between the supporting points 82 and 84, whereby the vector component B*y* is smaller than the vector component A*y*. If the spring 80 were to move further down to the position 80*c*, shown by the phantom line, the axial direction vector component will be zero. Such a position is generally called the neutral position. Still further downwards movement of the spring 80 causes its axial direction vector component to be directed in the opposite direction to the vector B*y*. When the switch unit 2 is manipulated by the operator or on external force, the movable body 6 is pushed into the housing 4 against the force shown by the vector A*y* which is gradually decreased to vector B*y*, thereby giving light touching sense to the operator when manipulating the switch unit 2 is manipulated.

When returning the switch unit 2 to the projected position, the friction force R1 produced between the contact members 50 and 56 and the inner wall of the housing 4 and the friction force R2 produced at the portions of the movable body 6 touching the housing 4 opposes the returning force (corresponding to vector B*y*). Therefore, it is required to make the spring 80 such that its returning force is greater than the sum of the friction forces R1 and R2.

Figure 7:
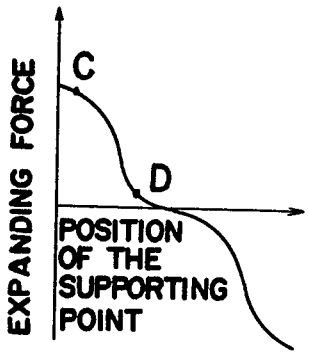
FIG. 7 is a graph showing the characteristics of the spring means shown in FIG. 6.

The graph shown in FIG. 7 shows the characteristics of the above described type of spring which is often a reversible spring because of its function. The abscissa designates the position of the supporting point 84, while the ordinate designates the expanding force of the spring 80 in the axial direction. The switch unit 2 of the present invention utilizes the spring 80 operating in the region somewhere between C and D.

It should be noted that the switch unit 2 of the above described type can have more than two contact members for connecting more than two pairs of terminals, in which case the tail portion of the housing may be further elongated.

Since the depressed position of the movable body 6 brings the spring 80 to a point just before its neutral position, as shown in the graph, the returning force of the spring 80 decreases at a high rate in relation to the distance of the depression. In other words, the change of the vector component in its size from A*y* to B*y* is at a high rate. Therefore, the switch unit 2 of the present invention gives the operator a light manipulating touch when operating the movable body 6, almost as if the body 6 were being drawn into the housing 4.

Referring now to FIGS. 8 to 11, there is shown a switch assembly 100 in which four switch units 2*a*, 2*b*, 2*c* and 2*d* are mounted on a supporting frame 102. The number of the switch units can range from one to any desired number, and four is merely an arbitrary number. The assembly 100 comprises the supporting frame 102, four switch units 2*a*, 2*b*, 2*c* and 2*d* mounted on the supporting frame 102, a casing 104 also mounted on the supporting frame 102 for placing therein a muting switch (not shown), a lock bar 106 to be slidably placed on the bottom of the supporting frame 102 and a leaf spring 108 for urging the lock bar 106 in one direction.

Figure 11:
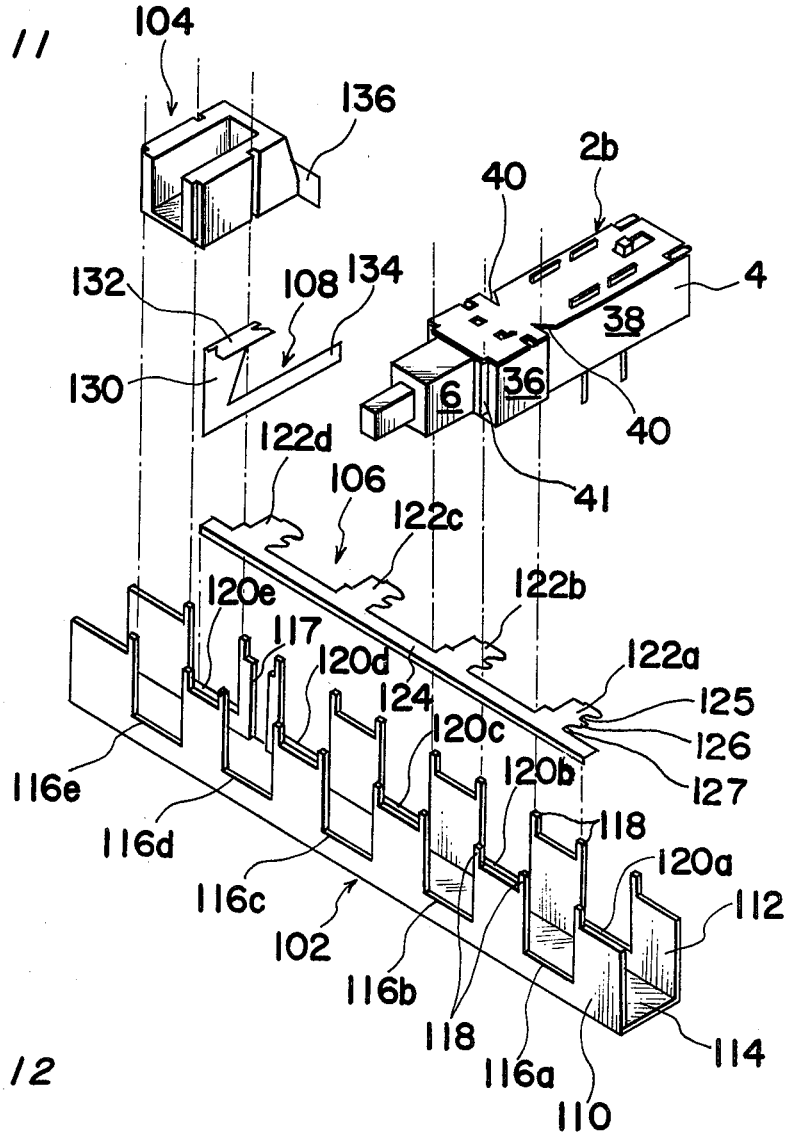
FIG. 11 is an exploded view of the switch assembly shown in FIG. 8, but showing only one switch unit for clarity.

Each of the elements for constructing the switch assembly 100 is described in detail in connection with FIG. 11, in which only the switch unit 2*b* is shown for clarity.

The supporting frame 102 made of metallic plate has a U-shaped cross section including a front panel 110, a rear panel 112 facing the front panel 110 and a base panel 114 extending between the front and rear panel at the bottom thereof. The front panel 110 has five rectangular recesses 116*a*, 116*b*, 116*c*, 116*d* and 116*e* formed along the top edge thereof at a predetermined pitch. Provided directly on both sides of each of the recesses is a projection 118. In a similar manner the rear panel 112 is provided with five recesses 120*a*, 120*b*, 120*c*, 120*d* and 120*e* and also with the projections 118. It should be noted that the recesses in the front panel 110 directly face the recesses in the rear panel 112.

In the rear panel 112, a recess 117 is provided between the recesses 120*d* and 120*e*, and the recess 117 reaches the base panel 114.

The lock bar 106 to be slidably placed on the base panel 114 is also made of metallic plate. The length of the lock bar 106 is approximately equal to the distance between the corresponding edges of the recesses 116*a* and 116*d*. The lock bar 106 has four lock members 122*a*, 122*b*, 122*c* and 122*d* projecting from the bar portion 124 thereof, at a pitch equal to the pitch of the above described recesses. The longitudinal edge of the lock bar 106 and the tip portion of each lock member are bent in the same direction at right angles to the lock box so that the lock members are spaced from the base panel 114. The width of the lock bar 106 is less narrower than the distance between the front and rear panels. Each lock member has a hook portion 126 at the middle portion thereof between two detent recesses 125 and 127 for engaging the projection 34 on the movable body 6. The detent recess 125 is provided for locking the movable body 6 in the depressed position by the engagement of the hook portion 126 and the detent recess 127 is provided for holding the movable body 6 in the projected position.

Figure 8:
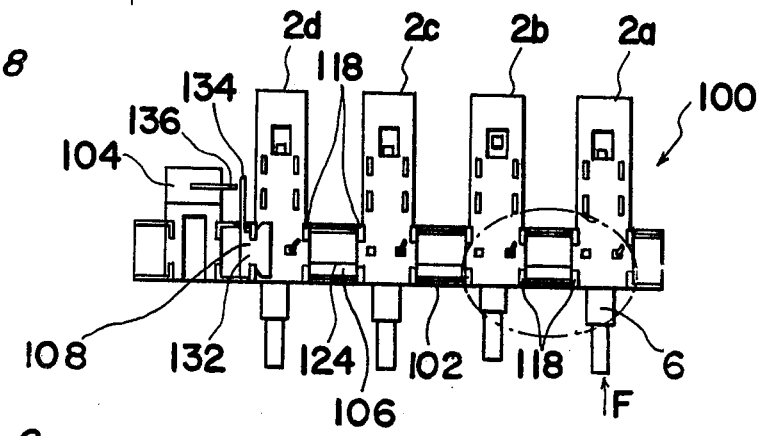
FIG. 8 is a top plan view of the assembly for the switch units aligned in a row.
Figure 9:
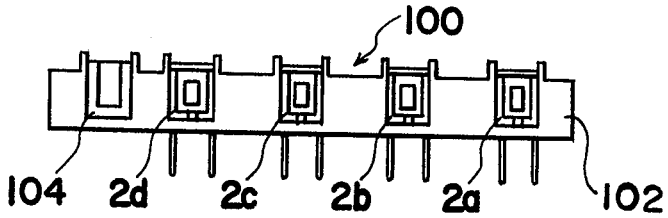
FIG. 9 is a front view of the switch assembly shown in FIG. 8.
Figure 10:
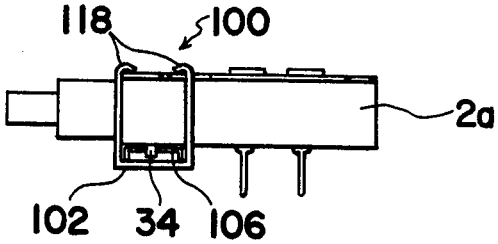
FIG. 10 is a side view of the switch assembly shown in FIG. 8.

After placing the lock bar 106 on the supporting frame 102, four switch units 2*a*, 2*b*, 2*c* and 2*d* are mounted on the supporting frame 102 in the recesses. The description hereinbelow is particularly directed to the manner of mounting the switch unit 2*b* on the supporting frame 102, although other switch units are mounted in the same manner. The recess 120*b* has the neck portion 40 of the switch unit 2*b* tightly fitted therein and the recess 116*b* has the tip of the head portion 36 where there is a step-like narrowed portion 41 fitted tightly therein. The switch unit 2*b* is completely inserted into the recesses 116*b* and 120*b* with the projection 34 positioned between the lock members 122*a* and 122*b*, and adjacent to the lock member 112*b*. The four projections 118 extend upwardly from the plane of the lid plate 8 at the four corners of the head portion and are bent over for tightly holding the head portion 36, thus securely holding the switch unit 2b. It should be noted that the projections 118 provided on the front panel 110 are bent over towards rear panel 112, while the projections 118 provided on the rear panel 112 are bent over towards front panel, as shown in FIGS. 8 and 10. Therefore, the neck portion 40 as well as the step-like narrowed portion 41 of the switch unit are not pressed or choked by the supporting frame 102.

The leaf spring 108, made of metallic plate material has a spring portion 130, a plate portion 132 integrally connected to the spring portion 130 at one end thereof at right angles thereto and an arm portion 134 extending from the other end of the spring portion 130. The leaf spring 108 is fixedly held by the projections 118 engaging the plate portion 132, together with the switch unit 2d. When positioning the leaf spring 108, the tip of the spring portion 130 contacts the end of the lock bar 106 and urges it in the rightward direction, so that each lock member engages with the projection 34 of the respective switch units. The arm portion 134 extends outwardly from the supporting frame 102 through the recess 117.

Provided in the recesses 116e and 120e is the casing 104 for placing the muting switch (not shown) therein, and being fixedly held thereat in a same manner as the switch units. The casing 104 has a plate 136 extending sidewways at the rear end thereof. The plate 136 and the arm portion 134 of the leaf spring 108 are normally spaced from each other.

Figure 12:
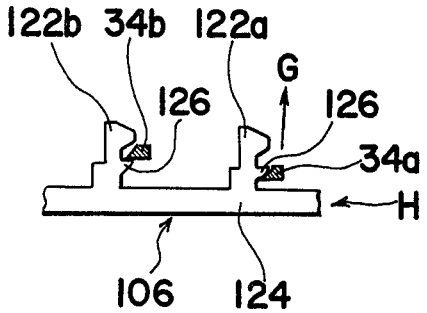
FIG. 12 is an enlarged schematic diagram showing the internal mechanism of the portion of the switch assembly encircled by a dotted line in FIG. 8.

Referring to FIG. 12, showing the internal mechanism of the switch assembly 100 encircled by a dotted line in FIG. 8, the numerals 34a and 34b designate the cross sections of the projection 34 in respective switch units 2a and 2b. As it is seen in FIG. 8, the condition of the switch assembly is such that the switch unit 2a is in the projected position, while the switch unit 2b is in the depressed position. Therefore, the projection 34a is disengaged from and the projection 34b is engaged with and locked with the corresponding hook portion 126. By the application of external pushing force F to the switch unit 2a, as shown in FIG. 8, the movable body 6 thereof is shifted into the housing, and at the same time, the projection 34a moves in the direction G, as shown in FIG. 12, sliding on the lock member 122a, thereby shifting the lock bar 106 in the direction H, against the force off leaf spring 130. Consequently, the projection 34b is disengaged from the lock portion 126 and the movable body 4 of the switch unit 2b projects outwardly in the OFF condition, while the projection 34a engages with the lock portion 126 upon the return of the lock bar 106 to its original position by the leaf spring 130. The resultant condition of the switch assembly 100 is such that the switch unit 2a is in the depressed position and the switch unit 2b is in the projected position.

During the period when the lock bar 106 is shifted in the direction H, the leaf spring 108 is pushed toward the casing 104, whereby the plate 136 contacts the tip of the arm portion 134. Such contact is utilized for switching the muting switch, which grounds the switch unit or other components attached to the switch unit for eliminating the noise produced by the change of the switch positions.

Figure 13:
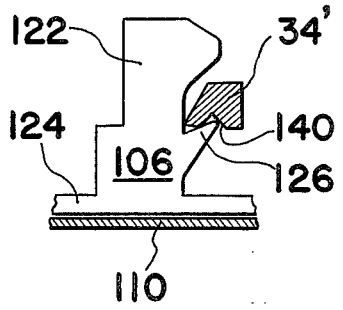
FIG. 13 is a fragmentary view, particularly showing the engaging means employed in the switch unit of FIG. 8.

Referring to FIG. 13, there is shown a cross sectional view of a projection 34', which is a modification of the projection 34, described above. Since the urging force of the spring 80, biasing the projection 34' towards the hook portion 126, is substantially weakened, owing to the reversible type spring 80, the engagement between the projection 34 and the hook portion 126 must be ensured.

The projection 34' in this modification has a V-shaped groove 140 on the surface which engages with the hook portion 126 of the lock member 122. The hook portion 126 is given such a shape that the tip portion thereof extends into the V-shaped groove 140 in the projection 34', so that the engagement between the hook portion 126 and the projection 34' is more sure than in the above described embodiment. Therefore, the engagement therebetween will not easily be disengaged by vibration or impacts applied to the switch unit 2 or the switch assembly 100.

Figure 14:
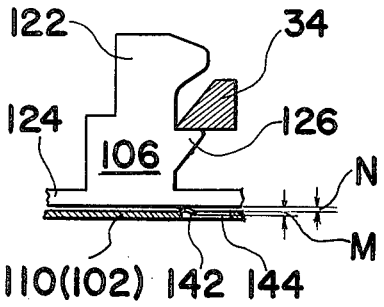
FIG. 14 is a view similar to FIG. 13, but particularly showing a modification thereof.

Referring to FIG. 14, there is shown a similar view to FIG. 13, but particularly showing a modification of the lock bar 106. In this modification, the bar portion 124 of the lock bar 106 has a raised cut piece 142, along the edge opposite the lock member 122. An opening 144 is provided in the front panel 110 of the supporting frame 102, which receives the cut piece 142 when the lock bar 106 is positioned in the original position.

It should be noted that the height M of the raised cut piece 142 is no larger than the space N between the opposed surfaces of the front panel 110 and the edge of the base portion 124.

Figure 15:
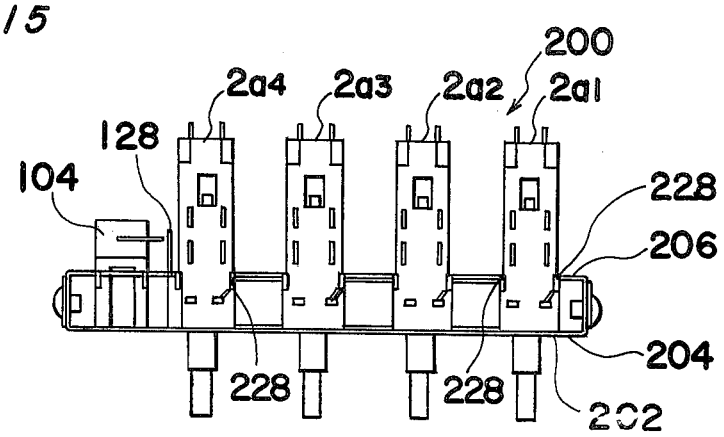
FIG. 15 is a top plan view of the assembly for the switch units aligned in a plurality of rows.
Figure 16:
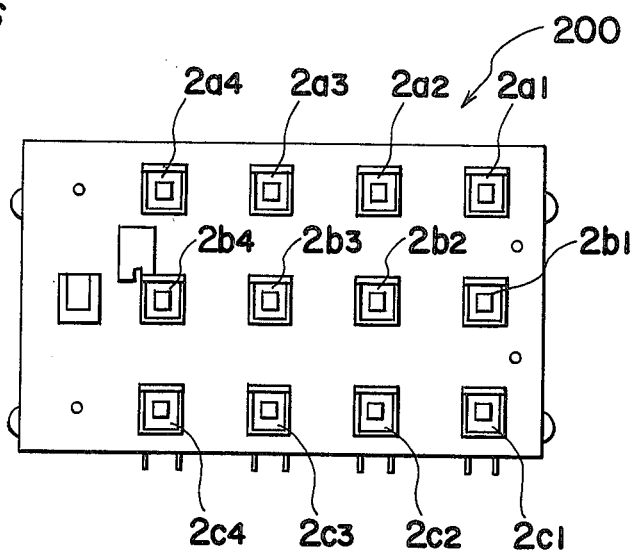
FIG. 16 is a front view of the switch assembly shown in FIG. 15.
Figure 17:
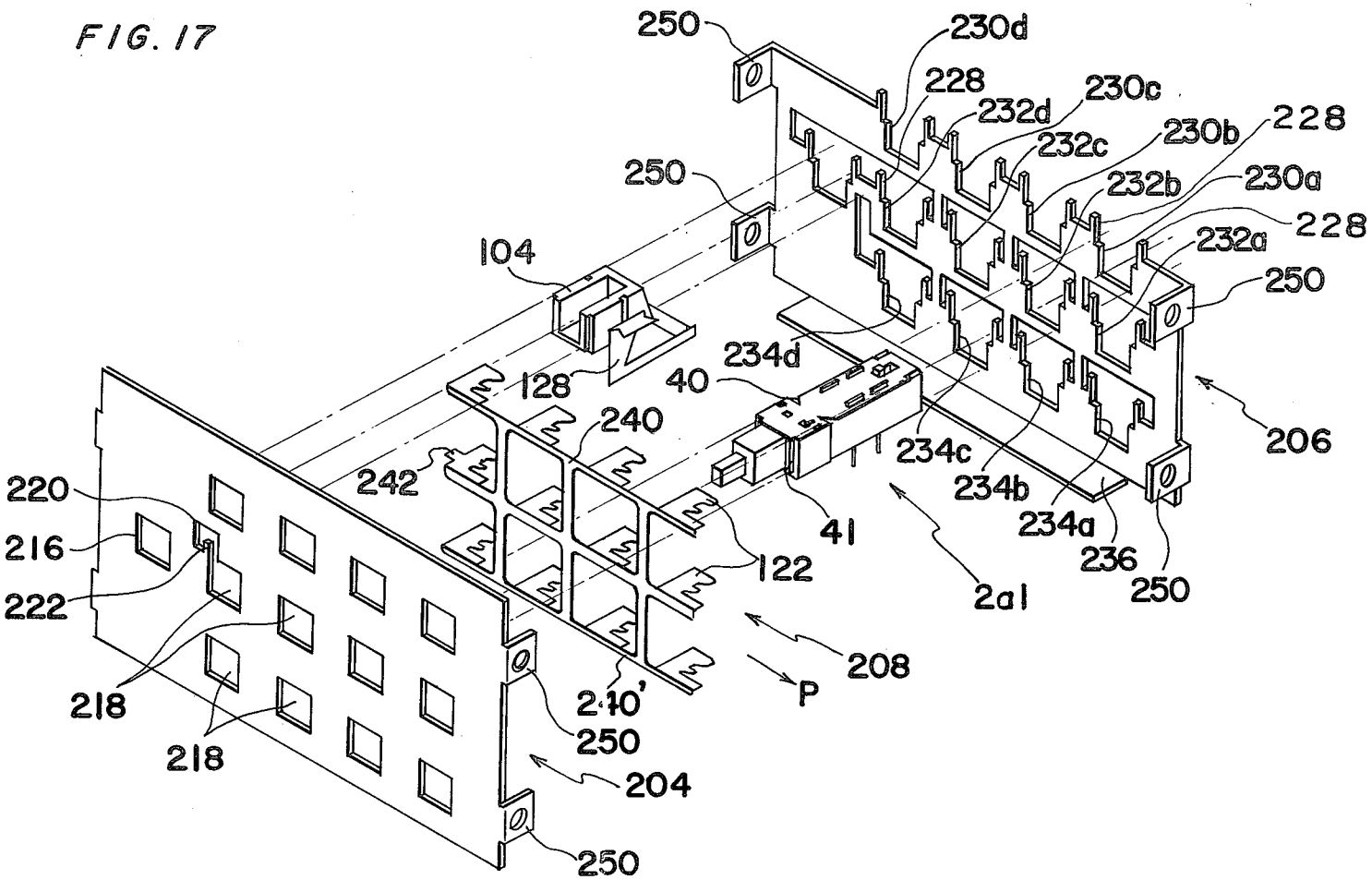
FIG. 17 is an exploded view of the switch assembly shown in FIG. 15, but in which only one switch unit is shown for clarity.

Referring now to FIGS. 15, 16 and 17, showing a switch assembly 200, twelve switch units are mounted on a supporting frame 202. More particularly, the twelve switch units are aligned in three rows with four switch units in each row. The switch units in the top row are designated by the reference numerals 2a1, 2a2, 2a3, and 2a4 from right to left, the switch units in the middle row are designated by the reference numerals 2b1, 2b2, 2b3 and 2b4, and the switch units in the bottom row are designated by the reference numerals 2c1, 2c2, 2c3 and 2c4. The number of the switch units, however, can range from two to any desired number, since twelve is merely an arbitrary number. The assembly 200 comprises the supporting frame 202 having front and rear frames 204 and 206, twelve switch units mounted on the supporting frame 202, a casing 104 also mounted on the supporting frame 102 for placing therein a muting switch (not shown), a lock element 208 having twelve lock members 122 and slidably placed between the front and rear frames 204 and 206 and the leaf spring 128.

Each of the elements for constructing the switch assembly 200 is described in detail in connection with FIG. 17, in which only the switch unit 2a1 is shown for clarity.

The front frame 204 provided for holding the front edge of the housing 4 of the switch unit has 13 square openings in three rows, four in the top row, five in the middle row and four in the bottom row. The opening formed at left hand side in the middle row, designated by the reference numeral 216 is for holding the front edge of the casing 104 and the rest of the openings, designated by the reference numeral 218, are for holding the front edge of the respective switch units. The opening 218 which is adjacent the opening 216 has an extension 220 provided with a projection 222.

The rear frame 206 provided for holding the neck portion 40 of the housing 4 of each switch unit, is formed with openings and recesses. Formed along the top edge of the rear frame 106 are four rectangular recesses 230a, 230b, 230c and 230d at a predetermined pitch. Each of the rectangular recesses 230a, 230b, 230c and 230*d* is broadened at the top portion thereof for easily placing the neck portion 40 of the housing therein. Provided directly on both sides of each of the recesses is a projection 228. Provided below the recesses 230*a*, 230*b*, 230*c* and 230*d* are four openings 232*a*, 232*b*, 232*c* and 232*d*, each having the same shape as that of the recess 230*a*, formed at the bottom of the opening. The opening 232*d* is extended to left hand side edge thereof for forming the same shape of recess thereat. Further provided below the four openings 232*a*, 232*b*, 232*c* and 232*d* are four openings 234*a*, 234*b*, 234*c* and 234*d* having the same shape as the opening 232*a*. The opening 234*d* is extended to the left for receiving the arm portion 134 of the leaf spring 128 therein. The rear frame 206 is provided with a base plate 236 at the bottom edge thereof at right angles thereto.

The lock element 208 to be placed between the front and the rear frames 204 and 206 has twelve lock members 122 of the above described type aligned in three rows, four lock members in each row. The twelve lock members are connected to each other by bar members 240 extending between the switch units. The lock member at the leftmost end of the middle row has a projection 242 for contacting the leaf spring 128.

The leaf spring 128 and the casing 104 are exactly the same as those described above.

The above described components of the switch assembly 200 are assembled as follows.

The neck portion 40 of the switch unit 2*a*1 is mounted in the recess 230*a* and the projections 228 adjacent the recess 230*a* are bent over for tightly holding the switch unit 2*a*1 thereat. The remaining eleven switch units and the casing 104 are assembled in the same manner. Then the lock element 208 is placed on the rear frame 206 with each lock member positioned adjacent to the projection 34 (not visible in FIG. 17) and with the bar member 240' at the bottom thereof being placed on the base plate 236, so that the lock element 208 is only allowed to slide back and forth in the direction P, shown in FIG. 17, in a preselected distance. Then the front frame 204 with the openings therein is engaged with the front edge 41 of the housing 4 of the switch unit. The leaf spring 128 can be fixedly held by the projection 228 adjacent the recess 232*d* in rear frame 206 and the projection 222 formed in the front frame 204 together with the switch unit 2*b*4 (not shown in FIG. 17) in the same manner as described in connection with the switch assembly 100. The tip portion of the leaf spring 128 contacts the projection 242 of the lock element 208 for urging the lock element 208 in the direction P. The front frame 204 and the rear frame 206 can be fixedly connected to each other by means of securing screws applied to bent portions 250 positioned at approximately the four corners of the frame 202.

The operation of the above described switch assembly 200 is such that the depression of the movable body 6 in any switch unit forces the lock element 208 to shift in a direction opposite to the direction P, thus resulting a disengagement between the lock member 122 and the projection 34 of the switch unit which had previously been positioned in the depressed position. When the lock element 208 returns to its original position, the just depressed switch unit is locked in the depressed position by the engagement between the projection 34 thereof and the hook portion of the lock member.

Since the switch units employed in the switch assemblies 100 and 200 are switch units having the reversible spring, the pushing force aplied to each of the switch units is so light that the operator may effect switching over in an easy manner with a light touch.

Furthermore, the switch assemblies as well as the switch unit are constructed from one direction, that is to say, the switch assemblies and the switch units are not required to be turned around or rotated in any direction during construction, so that the assembly line therefor can be arranged in a simple manner.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as included therein.

What is claimed is:

1. A push lock switch unit comprising;

a. an elongated housing having an opening at one end thereof and including at least one pair of spaced terminals each having one end situated within said housing and the other end projecting outwards from said housing for external electric connection;

b. an elongated movable body coaxially housed in said elongated housing for axial movement between depressed and projected positions, said movable body having one end extending outwards from said housing through said opening and the other end housed within said housing;

c. spring means connected between said elongated housing and said elongated movable body, said spring means consisting of a spring structure for exerting an expanding force in a diagonal direction with respect to the direction of movement of said elongated movable body for urging said elongated movable body only towards said projected position, said expanding force gradually decreasing as said elongated movable body is moved from said projected position towards said depressed position; and d. at least one contact member carried by said elongated movable body for electrically connecting said ends of said terminals within said housing to each other when said elongated movable body is moved to said depressed position by the application of an external pushing force to said body.

2. A push lock switch unit as claimed in claim 1, further comprising means for limiting the stroke of movement of said elongated movable body between said inserted and projected positions.

3. A push lock switch unit as claimed in claim 2, wherein said stroke limiting means is formed by a rectangular opening formed in one side wall of said housing and a pin portion formed in said elongated movable body and extending through said rectangular opening, said stroke being limited by the length of said rectangular opening in cooperation with said pin portion.

4. A push lock switch unit as claimed in claim 1, wherein said elongated housing is a casing member of a substantially U-shaped cross section having a chamber for accommodating said elongated movable body theren, and a covering member for closing the opening of said movable body.

5. A push lock switch unit as claimed in claim 1, wherein said spring means is a reversible spring.

6. A push lock switch unit as claimed in claim 5, wherein said reversible spring is a helical spring with opposite ends thereof extended.

7. A push lock switch unit as claimed in claim 5, wherein said reversible spring is a U-shaped wire spring.

* * * * *